US005156292A

United States Patent [19]

Ross

[11] Patent Number: 5,156,292

[45] Date of Patent: Oct. 20, 1992

[54] SMALL STORAGE CANISTER FOR RAW FOOD ARTICLES WITH SPECIAL AIRTIGHT COVERING MEMBER

[76] Inventor: Gary Ross, 140 Oxnard Ave., Oxnard, Calif. 93035

[21] Appl. No.: 646,680

[22] Filed: Jan. 28, 1991

[51] Int. Cl.[5] ..... B65D 45/04

[52] U.S. Cl. ..... 220/322; 220/323; 220/377; 220/326; 220/315; 215/280; 215/285

[58] Field of Search ..... 220/322, 315, 323, 324, 220/326, 358, 375, 377; 215/277, 280, 285, 286

[56] References Cited

U.S. PATENT DOCUMENTS

| | | | |
|---|---|---|---|
| 233,195 | 10/1880 | Bradley | 220/326 X |
| 282,188 | 7/1883 | Gilberds | 215/280 |
| 328,115 | 10/1885 | Gilberds | 215/280 |
| 380,091 | 3/1888 | Corey | 215/280 |
| 469,729 | 3/1892 | Van Vleck | 215/285 |
| 578,389 | 3/1897 | Challis | 220/322 X |
| 835,497 | 11/1906 | Briggs | 215/280 |
| 1,452,558 | 4/1923 | Jackson | 220/326 |
| 1,483,953 | 2/1924 | Rainey | 220/326 |
| 1,486,336 | 3/1924 | Heusser | 220/326 |
| 1,532,585 | 4/1925 | Culver | 215/285 |
| 1,712,140 | 5/1929 | Flegenheimer | 220/377 |
| 1,932,221 | 10/1933 | Krause | 220/326 |
| 2,643,044 | 6/1953 | Sundholm | 220/326 X |
| 3,236,402 | 2/1966 | Dellinger | 215/286 |
| 3,363,924 | 1/1968 | Remig | 220/323 X |
| 3,491,914 | 1/1970 | Elzey | 220/377 X |
| 3,503,535 | 3/1970 | Sparks, Sr. | 220/326 |
| 3,746,205 | 7/1973 | Helguera | 220/323 X |
| 3,817,563 | 6/1974 | McGlothlin | 220/326 X |
| 4,196,487 | 4/1980 | Merriman et al. | 215/286 X |
| 4,667,856 | 5/1987 | Nelson | 220/322 X |

*Primary Examiner*—Stephen Marcus
*Assistant Examiner*—Vanessa Caretto
*Attorney, Agent, or Firm*—Thomas I. Rozsa

[57] ABSTRACT

An airtight canister including (a) a ceramic container having an open top, a bottom and an annular groove adjacent to the bottom; (b) an acrylic cover having an annular rim; (c) an annular rubber gasket wrapped on the annular rim of the cover; (d) an elongated elastic cord having two ends; (e) a wave shaped hook linked to said cord between the two ends; and (f) a generally "π"-shaped connecting member connected between the two ends of said cord and said cover; (g) so that when the cover is placed onto the open top of the container and the hook is retained by the annular groove adjacent to the bottom of the container, the tension of the elastic cord will maintain a pressure on the cover through the connecting member, which in turn creates an airtight coverage with the help of the gasket.

22 Claims, 1 Drawing Sheet

SMALL STORAGE CANISTER FOR RAW FOOD ARTICLES WITH SPECIAL AIRTIGHT COVERING MEMBER

BACKGROUND OF THE INVENTION

1. Field of the Invention

The present invention relates to the field of small storage canisters for raw food articles. More particularly the present invention relates to the field of small airtight storage canisters for raw food articles.

2. Description of the Prior Art

Small storage canisters are often used in kitchens for storing raw food articles such as flour, sugar, granola and coffee beans. One important criteria for those canisters is whether it is airtight or not. Some raw food articles, such as coffee beans, are better stored under airtight conditions to preserve their preferred qualities including natural flavors, freshness, and sometimes even, dryness.

Airtight and non-airtight canisters are very different. Airtight canisters usually require a more complicated closure mechanism to ensure the airtightness. Although airtight canisters are made of many kinds of materials, including ceramic, wood, glass and acrylic, with numerous variations in their shapes and sizes, there are only a few different mechanical designs for the airtight closure means currently available on the market.

A typical covered canister comprises a container and a cover. The container and the cover are often made of the same material such as ceramic, wood, glass and acrylic. The container is usually cylindrical shaped with a closed bottom and an open top. For non-airtight canisters the cover is merely resting over the open top of the container. For airtight canisters, the cover cannot just rest on the open top of the container. One way to ensure the airtightness is to add a sealing gasket or washer between the cover and the open top of the container. Another way to ensure the airtightness is to employ some kind of mechanical means to tightly attach the cover to the open top of the container.

Although there are many mechanical means available, the application of the small airtight canisters as normal housewares requires that the mechanical means be simple and easy to produce and operate. There are two common types of conventional airtight covering means commonly used for small housewares. One common type of conventional airtight canister utilizes various types of screw means for attaching the cover and the container. The disadvantage of this type of canister closure that it requires extra effort to operate the screw means. Another common type of conventional airtight canister closure mechanism comprises a wire around the cover and another wire around the open top of the container. The two wires are usually metal wires. At the front of the canister the two wires are attached by a leverage tab which also can be made of metal wires. At the rear of the canister the two wires are either hingeably attached by a hinge means or detachably attached by another leverage tab. The disadvantage of this type of conventional canister closure mechanism is that the leverage tabs are sometimes difficult to use, especially for those elderly people with less strength in their hands.

Recently there is a new design airtight canister with the trade name CLICK CLACK. It has two mechanical squeezable tabs in the center of a cover tightly fitted on a container which, when squeezed, reduces the diameter of the cover to therefore allow it to be removed from the container. This product is available only in acrylic. The drawback, however, is that for some kinds of raw food articles the canisters made of acrylic are not suitable. For example, acids in coffee beans can hurt the surface of acrylic containers. It is preferable to use traditional glass or ceramic containers which resist harsh materials in some raw food articles.

SUMMARY OF THE PRESENT INVENTION

The present invention is a small storage canister for raw food articles with special airtight covering means.

It is known that airtight coverage is preferred for many kinds of small canisters used for storing raw food articles. An airtight canister used for normal housewares typically comprises a container and a cover, and mechanical covering means for tightly securing the cover to the container. In addition, a sealing gasket is often utilized with the cover to ensure the tight fit. However, the various types of small airtight canisters used for normal housewares currently available on the market have their respective drawbacks.

It has been discovered, according to the present invention, that if a pressure is maintained on the cover which pushes the cover against the open top of the container with a resilient gasket therein between, then the coverage can be maintained airtight.

It has also been discovered, according to the present invention, that if an elastic cord is connected at its two ends to the cover by a connecting means and hooked down at its middle point to the container at a location adjacent to the bottom of the container by a hooking means, then a downward pressure can be maintained on the cover which pushes it against the open top of the container.

It has further been discovered, according to the present invention, that if the two ends of the elastic cord are attached to the cover through a connecting means which contacts the cover at two spaced apart locations along a diameter of the cover, then the downward pressure on the cover is evenly distributed on the cover which in turn ensures the airtight fitting among the cover, the gasket and the container.

It has additionally been discovered, according to the present invention, that if an annular shelf with outer annular lid is configured at the open top of the container, then the cover can be securely placed on the annular shelf and guarded by the annular lip.

It has additionally been discovered, according to the present invention, that if an annular groove is configured at the bottom of the container, then the hooking means can be hooked into the annular groove without extra loop means for the hooking means.

It is therefore an object of the present invention to provide a small storage canister for raw food articles with special airtight covering means comprising a container, a cover and a resilient gasket wherein a pressure is maintained on the cover which pushes the cover against the open top of the container with the gasket therein between, so that the coverage can be maintained airtight.

It is also an object of the present invention to provide a small storage canister for raw food articles with special airtight covering means comprising an elastic cord and a hook wherein the elastic cord is attached at its two ends to the cover by a connecting means and hooked down at its middle point to the container at a location adjacent to the bottom of the container by the hook, so that a downward pressure can be maintained on the cover which pushes it against the open top of the container.

It is a further object of the present invention to provide a small storage canister for raw food articles with special airtight covering means comprising a connecting means wherein the two ends of the elastic cord is attached to the cover through the connecting means which contacts the cover at two spaced apart locations along a diameter of the cover, so that the downward pressure on the cover is evenly distributed on the cover which in turn ensures the airtight fitting among the cover, the gasket and the container.

It is a further object of the present invention to provide a small storage canister for raw food articles with special airtight covering means wherein an annular shelf with outer annular lid is configured at the open top of the container, so that the cover can be securely placed on the annular shelf and guarded by the annular lip.

It is a further object of the present invention to provide a small storage canister for raw food articles with special airtight covering means wherein an annular groove is configured at the bottom of the container, so that the hooking means can be hooked into the annular groove without extra loop means for the hooking means.

It is also an object of the present invention to provide a small storage canister for raw food articles with special airtight covering means wherein the body of the canister, e.g. the container, is made of acid resistant material such as ceramic, so that the canister can be used for storage of all kinds of raw food articles including coffee beans.

It is also an object of the present invention to provide a small storage canister for raw food articles with special airtight covering means wherein the cover of the canister is made of transparent material such as acrylic or glass, so that the contents of the canister can be seen without opening the cover.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
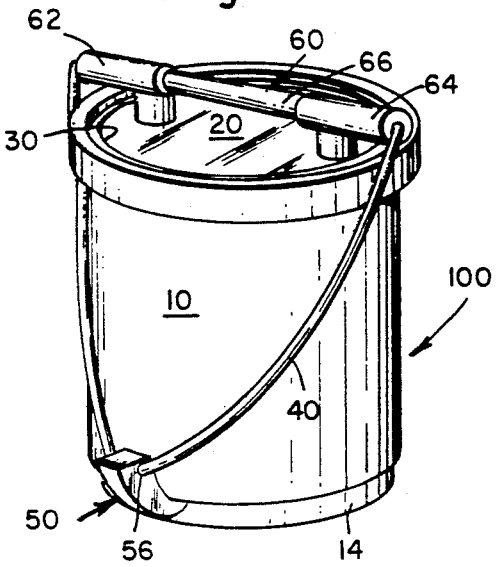
FIG. 1 is a perspective view of the present invention small storage canister for raw food articles with special airtight covering means.

Referring to FIG. 1, there is shown at 100 an airtight canister of the present invention. Airtight canister 100 comprises a generally cylindrical shaped container 10, a generally round disk shaped cover 20, an annular resilient gasket 30, an elongated elastic cord 40, a wave shaped hook 50 slidably linked to cord 40, and a generally "$\pi$"-shaped connecting means 60. A perspective view of container 10 is shown in FIG. 2, and a perspective view of cover 20 attached with connecting means 60 is shown in FIG. 4.

Figure 2:
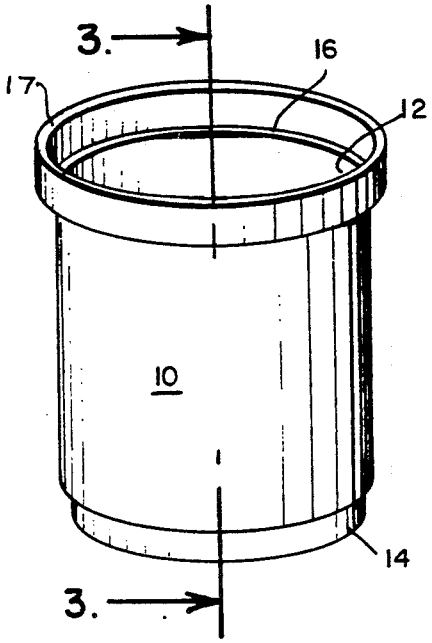
FIG. 2 is a perspective view of the container body of the canister of the present invention small storage canister for raw food articles.
Figure 3:
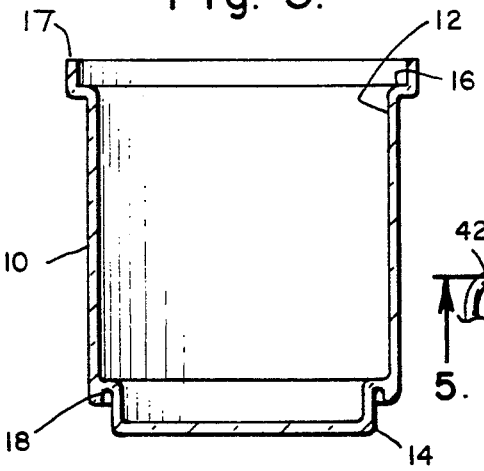
FIG. 3 is a partial cross-sectional view taken along line 3—3 of FIG. 2.

Referring to FIG. 2, container 10 has an open top 12 and a bottom 14. A cross-sectional view of container 10 taken along line 3—3 of FIG. 2 is shown in FIG. 3. As FIG. 3 shows in detail, container 10 further has an annular shelf 16 adjacent to open top 12 for receiving cover 20, an annular lip 17 integrally extending upwardly from annular shelf 16 to guard cover 20, and an annular groove 18 adjacent to bottom 14 for receiving hook 50. The special configuration of container 10 has the following benefits: (a) annular shelf 16 ensures that cover 20 is suitably fitted on open top 12 of container 10; (b) annular lip 17 prevents cover 20 from slipping off open top 12 of container 10; (c) annular groove 18 eliminates the need for having extra separate means for receiving hook 50; and (d) many containers can be efficiently stacked together for shipping. Container 10 is preferably made of ceramic material for its resisting harsh substances such as acid contained in some raw food articles such as coffee beans.

Figure 4:
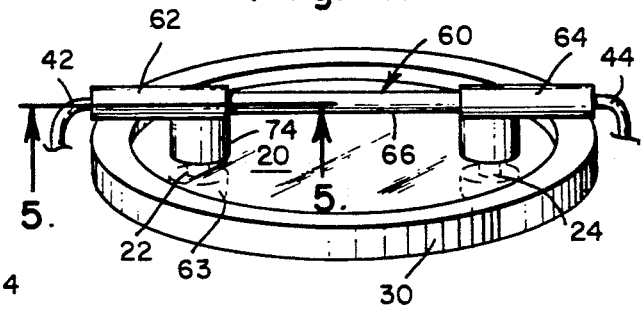
FIG. 4 is a perspective view of the special airtight covering means of the present invention small storage canister for raw food articles.
Figure 5:
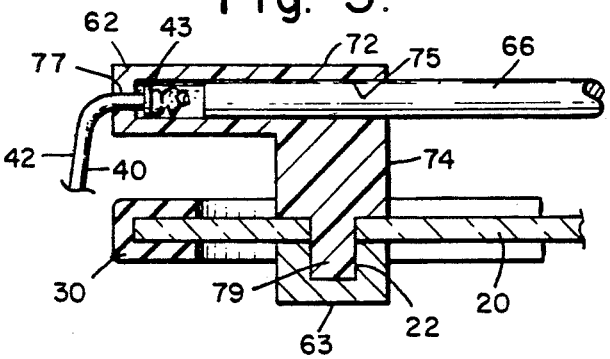
FIG. 5 is a cross-sectional view taken along line 5—5 of FIG. 4.

Referring to FIG. 4, cover 20 is a thin round disk having an annular rim wrapped by annular resilient gasket 30. There are two small through holes 22 and 24 on cover 20 located at two spaced apart locations along a diameter of cover 20. Generally "$\pi$"-shaped connecting means 60 is attached onto cover 20 and connected with two ends 42 and 44 of elongated elastic cord 40. Connecting means 60 is detachably assembled by two generally "L"-shaped joints 62 and 64 and a cross bar 66. FIG. 5 is a partial cross-sectional view taken along line 5—5 of FIG. 4, which shows half of the attachment shown in FIG. 4. The other half is similar to the shown half. Referring to FIG. 5, generally "L"-shaped joint 62 has a hollow portion 72 and a stand portion 74. Hollow portion 72 has a large opening 75 at one end to retain cross bar 66, and a small opening 77 at the other end to retain one of the two ends, end 42, of elastic cord 40. When end 42 of cord 40 is pierced through small opening 77 the tip of cord 40 is clamped by a metal band 43 which is wider than the diameter of small opening 77 so end 42 of cord 40 is attached to joint 62. Stand portion 74 of joint 62 has a narrower tip 79 which is adapted to go through one of the two small holes, hole 22, of cover 20, and then affixed by a snap-on piece 63 to secure the connection. FIG. 5 also shows how annular resilient gasket 30 is wrapped onto the annular rim of cover 20.

In the preferred embodiments of the present invention, cover 20 is made of transparent acrylic material, gasket 30 is made of rubber material, joints 62 and 64, and are made of plastic material, cross bar 66 is made of any material including wood or plastic. Acrylic cover is unbreakable, durable and easy to clean. It is transparent so that the contents stored inside the canister can be viewed without opening the cover. The components of the present invention canister assembly can also be made of other suitable materials. For example, cover 20 can be made of glass material as well.

Figure 6:
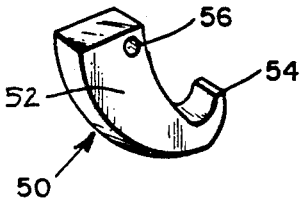
FIG. 6 is a perspective view of the hooking means of the special airtight covering means of the present invention small storage canister for raw food articles.

Wave shaped hook 50 is shown in FIG. 6. Hook 50 has a wave shaped body portion 52 adapted to be held easily, a hook portion 54 adapted to hook into annular groove 18 adjacent to bottom 14 of container 10, and a through hole 56 remote from hook portion 54 for linking with elastic cord 40 at a location between its two ends 42 and 44. Hook 50 is preferably made of plastic, but other material may be utilized. Body portion 52 of hook 50 may also be configured in other shapes.

The present invention canister is readily assembled such that everything other than container 10 is attached as a whole covering means as described earlier. To use the present invention canister, after raw food articles are poured into container 10, the whole covering means is placed on open top 12 of container 10 such that the annular rim of cover 20, which is wrapped by annular gasket 30, rests on annular shelf 16. By pushing down hook 50 to clasp it to annular groove 18 at bottom 14 of container 10, the tension in elastic cord 40 maintains a downward pressure on cover 20 through connecting means 60, which in turn creates an airtight coverage. Resilient gasket 30 helps the sealing, and is further resistant to the slipping of cover 20. Also, annular lip 17 surrounding annular shelf 16 at open top 12 of container 10 will prevent cover 20 from slipping off open top 12 of container 10. To view the contents, the whole covering means does not need to be removed since cover 20 is clear. To access the contents, the whole covering means can be easily removed by simply pushing down hook 50 again to release it from annular groove 18 at bottom 14 of container 10. The whole covering means can be removed from open top 12 of container 10, so the contents can be poured out. This feature is not available for some prior art canisters wherein the cover is hinged to the container. Also operating the elastic cord and hook is easier and requiring less strength for elderly people than some prior art canisters wherein the closing mechanism involves a leverage tab made of metal wires.

The present invention has many advantageous features including: (a) it is easy to operate; (b) it is made of durable materials for long lasting use; (c) the container is made of ceramic which is resistant to harsh materials; (d) the cover is made of acrylic which is unbreakable and transparent; (e) when opened the cover is completely detached and removable which makes it more convenient to pour the contents out; (f) the design of the container allows the container to be stacked, which makes it more efficient to transport the container.

Defined in detail, the present invention is an airtight canister comprising: (a) a generally cylindrical shaped container having an open top, a bottom, an annular shelf adjacent to the open top, and an annular groove adjacent to the bottom; (b) a round disk shaped transparent cover having an annular rim and two spaced apart openings located along a diameter of the cover; (c) an annular resilient gasket wrapped onto the annular rim of said cover; (d) an elongated elastic cord having a first end and a second end; (e) a wave shaped hook slidably linked to said cord between the first end and the second end; and (f) a connecting means having a generally "$\pi$"-shaped configuration and detachably assembled by a first generally "L"-shaped joint connected with the first end of said elastic cord, a second generally "L"-shaped joint connected with the second end of said elastic cord, and a cross bar connecting the first and second "L"-shaped joints, where a portion of the first and second "L" shaped joints are mounted to said cover by extending into one of said two spaced apart openings; (g) whereby when said cover is placed onto the annular shelf adjacent to the open top of said container and said wave shaped hook is retained by the annular groove adjacent to the bottom of said container, the tension of said elastic cord will maintain a pressure on said cover through said connecting means, which in turn creates an airtight coverage with the help of said resilient gasket.

In one of the preferred embodiments of the present invention defined in detail, (a) the container further comprises an annular lip at the open top surrounding the annular shelf to guard said cover placed on the annular shelf; (b) the container is made of ceramic material; (c) the cover is made of acrylic material; (d) the gasket is made of rubber material; (e) the hook is made of plastic material; (f) the first and second generally "L"-shaped joints are made of plastic material; and (g) the cross bar is made of wood material.

Defined broadly, the present invention is an airtight canister comprising: (a) a container having an open top, a bottom and an annular groove adjacent to the bottom; (b) a cover; (c) an elongated elastic cord having two ends; (d) a hook linked to said cord between the two ends; and (e) a connecting means connected between the two ends of said cord and said cover; (f) whereby when said cover is placed onto the open top of said container and said hook is retained by the annular groove adjacent to the bottom of said container, the tension of said elastic cord will maintain a pressure on said cover through said connecting means, which in turn creates an airtight coverage.

In one of the preferred embodiments of the present invention defined broadly, said connecting means is generally "$\pi$"-shaped which has a longitudinal shaft with two ends and two transversal stands, where the two ends of the longitudinal shaft are connected with the two ends of said elastic cord respectively, and the two transversal stands are mounted to said cover at two spaced apart locations along a diameter of said cover respectively.

Defined more broadly, the present invention is an airtight canister comprising: (a) a container having an open top and a bottom; (b) a cover; (c) an elastic cord; (d) a connecting means connecting at least one portion of said cord to said cover; and (e) a retaining means retaining said cord at another portion remote from the at least one portion to said container at a location remote from the open top; (e) whereby when said cover is placed onto the open top of said container and said cord is retained by said retaining means to said container, the tension of said elastic cord will maintain a pressure on said cover which in turn creates an airtight coverage.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the board features or principles of the present invention, or the scope of patent monopoly to be granted.

What is claimed is:

1. An airtight canister comprising:

a. a generally cylindrical shaped container having an open top, a bottom, an annular shelf adjacent to the open top, and an annular groove adjacent to the bottom;

b. a round disk shaped transparent cover having an annular rim and two spaced apart openings located along a diameter of the cover;

c. an annular resilient gasket wrapped onto the annular rim of said cover;

d. an elongated elastic cord having a first end and a second end, the cord having elastic tension;

e. a wave shaped hook slidably linked to said cord between the first end and the second end; and f. a connecting means having a generally "$\pi$"-shaped configuration and detachably assembled by a first generally "L"-shaped joint connected with the first end of said elastic cord, a second generally "L"-shaped joint connected with the second end of said elastic cord, and a cross bar connecting the first and second "L"-shaped joints, where a portion of the first and second "L"-shaped joints are mounted to said cover extending into one of said two spaced apart openings;

g. whereby when said cover is placed onto the annular shelf adjacent to the open top of said container and said wave shaped hook is retained by the annular groove adjacent to the bottom of said container, the tension of said elastic cord will maintain a pressure on said cover through said connecting means, which in turn creates an airtight coverage, and the airtight coverage is further ensured by said resilient gasket.

2. The canister as defined in claim 1 wherein said container further comprises an annular lip at the open top integrally extending upwardly from the annular shelf to guard said cover placed on the annular shelf.

3. The canister as defined in claim 1 wherein said container is made of ceramic material.

4. The canister as defined in claim 1 wherein said cover is made of acrylic material.

5. The canister as defined in claim 1 wherein said gasket is made of rubber material.

6. The canister as defined in claim 1 wherein said hook is made of plastic material.

7. The canister as defined in claim 1 wherein said first and second generally "L"-shaped joints are made of plastic material.

8. The canister as defined in claim 1 wherein said cross bar is made of wood material.

9. An airtight canister comprising:

a. a container having an open top, a bottom and an annular groove adjacent to the bottom;

b. a cover;

c. an elongated elastic cord having tow ends, the cord having elastic tension;

d. a hook linked to said cord between the two ends; and e. a connecting means connected between the two ends of said cord and said cover;

f. whereby when said cover is placed onto the open top of said container and said hook is retained by the annular groove adjacent to the bottom of said container, the tension of said elastic cord will remain a pressure on said cover through said connecting means, which in turn creates an airtight coverage.

10. The canister as defined in claim 9 wherein said container is made of ceramic material.

11. The canister as defined in claim 9 wherein said cover is made of acrylic material.

12. The canister as defined in claim 9 wherein said hook is made of plastic material.

13. The canister as defined in claim 9 further comprising an annular resilient gasket positioned between said cover and the open top of said container.

14. The canister as defined in claim 13 wherein said gasket is made of rubber material.

15. The canister as defined in claim 9 wherein said connecting means is generally "$\pi$"-shaped which has a longitudinal shaft with two ends and two transversal stands, where the two ends of the longitudinal shaft are connected with the two ends of said elastic cord respectively, and the two transversal stands are mounted to said cover at two spaced apart locations along a diameter of said cover respectively.

16. An airtight canister comprising:

a. a container having an open top and an annular groove remote from the open top;

b. a cover;

c. an elongated cord having elastic tension;

d. a connecting means connecting at least one portion of said cord to said cover; and e. a retaining means attached to said cord at another portion remote from said at least one portion of said cord;

f. whereby when said cover is placed onto the open top of said container and said retaining means is retained by said annular groove of said container, the tension of said elongated cord will maintain a pressure on said cover which in turn creates an airtight coverage.

17. The canister as defined in claim 16 wherein said container is made of ceramic material.

18. The canister as defined in claim 16 wherein said cover is made of acrylic material.

19. The canister as defined in claim 16 further comprising a resilient gasket positioned between said cover and the open top of said container.

20. The canister as defined in claim 19 wherein said gasket is made of rubber material.

21. An airtight canister comprising:

a. a container having an open top and an annular groove remote from the top;

b. a cover;

c. a connecting means attached to said cover;

d. an elongated cord having two ends elastically attached to said connecting means such that a tension is created on the cord; and e. a retaining means attached to said cord a portion between said two ends;

f. wehreby when said cover is placed onto the open top of said container and said retained means is retained by said annular groove of said container, the tension of said elongated cord will maintain a pressure on said cover which in turn creates an airtight coverage.

22. The canister as defined in claim 21 wherein said connecting means is a generally "$\pi$"-shaped member having an elongated horizontal shaft for attachment of said two ends of said elongated cord and two vertical stands for attachment with said cover at two spaced apart locations.

* * * * *